United States Patent [19]

Washington et al.

[11] Patent Number: 4,482,836

[45] Date of Patent: Nov. 13, 1984

[54] ELECTRON MULTIPLIERS

[75] Inventors: Derek Washington, E. Grinstead; Hewson N. G. King, Redhill; Pamela M. Stubberfield, Croydon, all of England

[73] Assignee: U.S. Philips Corporation, New York, N.Y.

[21] Appl. No.: 85,580

[22] Filed: Oct. 17, 1979

Related U.S. Application Data

[63] Continuation of Ser. No. 748,699, Dec. 8, 1976, abandoned, which is a continuation of Ser. No. 598,234, Jul. 23, 1975, abandoned, which is a continuation of Ser. No. 456,374, Mar. 29, 1974, abandoned.

[30] Foreign Application Priority Data

Apr. 6, 1973 [GB] United Kingdom ..... 16541/73

[51] Int. Cl.[3] ..... H01J 43/00

[52] U.S. Cl. ..... 313/104; 313/105 CM

[58] Field of Search ..... 313/103 CM, 104, 105 CM, 313/105 R

[56] References Cited

U.S. PATENT DOCUMENTS

| | | | |
|---|---|---|---|
| 2,579,665 | 12/1951 | Green | 313/408 X |
| 3,231,380 | 1/1966 | Law | 313/402 X |
| 3,265,916 | 8/1966 | Vestal | 313/105 |
| 3,458,745 | 7/1969 | Shoulders | 313/105 CM X |
| 3,483,422 | 12/1969 | Novotny | 313/105 CM X |

OTHER PUBLICATIONS

Jares et al., "A Flat Channel System for Imaging Purposes;" Advances in Electronics and Electronic Physics, vol. 33A, 1972, Academic Press, pp. 117–122.

*Primary Examiner*—Moore, David K.
*Attorney, Agent, or Firm*—Jack E. Haken

[57] ABSTRACT

A channel plate electron multiplier of the discrete dynode type formed from conductive sheets which are stacked in closely spaced relation. Each sheet is perforated with apertures which are aligned to form electron multiplying channels. The apertures in each sheet have input and output and cross sections which are approximately the same size and a concave shaped inner surface profile which causes a majority of electrons to strike the inner surface close to the output end, whereby the gain of the multiplier is increased.

6 Claims, 13 Drawing Figures

ELECTRON MULTIPLIERS

Figure 1A:
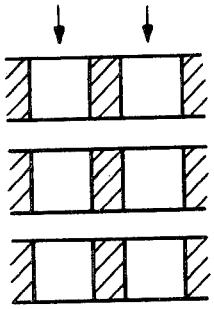
Fig. 1A PRIOR ART

This is a continuation of Ser. No. 748,699, filed Dec. 8, 1976, abandoned, which is a continuation of Ser. No. 598,234, filed July 23, 1975, abandoned, which is a continuation of Ser. No. 456,374, filed Mar. 29, 1974, abandoned.

This invention relates to electron multipliers and more particularly to electron multipliers of the channel plate type. The invention is applicable to channel plates for use in electronic imaging and display applications.

In present practice a "channel plate" is a secondary-emissive electron-multiplier device comprising a matrix in the form of a plate having a large number of elongate channels passing through its thickness, said plate having a first conductive layer on its input face and a separate second conductive layer on its output face to act respectively as input and output electrodes.

Secondary-emissive intensifier devices of this character are described, for example, in British patent specification No. 1,064,073 (PHB 31172), No. 1,064,074 (PHB 31173), No. 1,064,076 (PHB 31184), No. 1,090,406 (PHB 31211) and No. 1,154,515 (PHB 31754), while methods of manufacture are described in patent specification No. 1,064,072 (PHB 31171 Comb), and No. 1,064,075 (PHB 31183).

The channel plates described in these specifications can be regarded as continuous-dynode devices in that the material of the matrix is continuous (though not necessarily uniform) in the direction of thickness, or the direction of the channels. In their operation a potential difference is applied between the two electrode layers of the matrix so as to set up an electric field to accelerate the electrons, which field establishes a potential gradient created by current flowing through resistive surfaces formed inside the channels or (if such channel surfaces are absent) through the bulk material of the matrix. As in all channel plates, secondary-emissive multiplication takes place in the channels.

More recently, various modifications have been proposed which will be referred to as "laminated" channel plates in contrast with the conventional continuous-dynode type of channel plate. Some of these proposals hark back to an earlier proposal which appeared in 1960 when Durns and Neumann published details of a channel plate made up of a number of perforate metal layers separated from each other by layers of insulator (J. Burns and M. J. Neumann, Advances in Electronics and Electron Physics XII 1960 pages 97–111). In this and the more recent modifications the continuous matrix of the conventional channel plate structure is replaced by a stack of perforate conductive sheets or plates which are separated from each other and act as discrete dynodes. The laminated channel plate structure which is closest to the continuous dynode type is a structure in accordance with British patent specification No. . . . (application No. 53371/71; PHB 32212), wherein the matrix is formed as a laminated structure comprising alternate conductor layers and resistive separator layers with aligned apertures providing the channels. Since the separators are resistive, any charge accumulated thereon by the arrival of electrons will flow to the more positive adjacent conductor. Similarly, electrons will flow from the more negative adjacent conductor to replace any secondary electrons emitted from a resistive layer. It is preferable in many cases to modify the laminated structure still further by changing the separator material from a resistive or slightly conductive material to an insulator as in the arrangement of Burns et al, in which case the provision of an individual d.c. supply for each conductor layer becomes a necessity. In this case the conductor layers provide the entire dynode action and the edges of the separator layers may be set back from the channel apertures so as to be protected from the electron flow in order to prevent the formation of static changes. Furthermore, the first and last conductor dynode layers act also as the input electrode and the output electrode respectively.

Thus for the physical separation of the individual channels has been preserved, but that too can be modified since the insulating separator layers can no longer take part in the secondary-emission and current-supply functions and therefore no longer need to be continuous. Examples of discontinuous separator layers are given in patent specification No. . . . (Co-pending application No. 59966/71—PHB 32220) and these include separators formed as arrays of lines or dots of separator material.

In the Burns et al arrangement and in the examples described in the aforesaid patent specification No. . . . (PHB 32212) and No. . . . (PHB 32220) the a the conductor layers are of conical form, and an alternative cylindrical form has been described elsewhere. Such known straight-sided configurations are illustrated respectively in FIGS. 1A and 1B of the diagrammatic drawings accompanying the Provisional Specification. These suffer from penetration of the electric field into each dynode aperture due to the potential applied to the preceding dynode. This results in a retarding field which prevents low-energy (i.e. a few eV) secondary electrons from leaving the wall at the input end of each aperture where they encounter a retarding field (the affected area is indicated schematically at R in FIG. 2 of the said drawings). As the majority of secondaries have low emission energies, this effect is significant and some 50% of the wall area can be so affected.

Figure 1B:
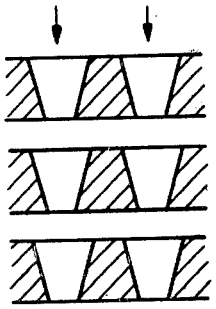
Fig. 1B PRIOR ART
Figure 2:
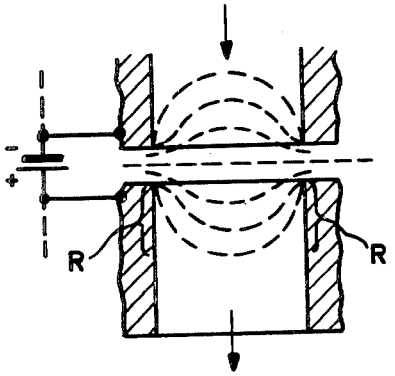
Fig.2 PRIOR ART
Figure 3:
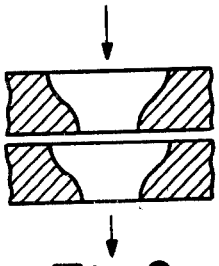
Fig.3 PRIOR ART

In the case of FIG. 1B, as the apertures are wider on the input side the potential of the preceding dynode has even more influence on the field within the hole. This is also true in the case of a dynode aperture configuration of tapered form having curved walls as published by V. Jares and M. Dvorak at pp. 117 et seq of "Advances in Electronics and Electron Physics" (Edited by L. Marton, Vol. 33A, Academic Press, 1972) (the authors have obtained such an arrangement by using a stick of shadow-masks as used for colour T.V. tubes, and this is illustrated in FIG. 3 of the said drawings).

The principal object of the present invention is to reduce or overcome this effect of field penetration and the invention is based on the following principle. If incoming electrons can be prevented from landing on the unproductive input region of the wall of each aperture of a discrete dynode, the efficiency can be improved as electrons can then only land on regions where secondaries are accelerated away from the surface. (This assumes that these secondaries land on subsequent dynodes and are not accelerated axially through the hole).

In its first aspect, the invention provides a dynode of perforate sheet form having an array of secondary-emissive electron-multiplier apertures each of which apertures has inner surfaces which when viewed in axial section (as defined) are concave with a degree of overhang at the input face of the dynode and a degree of constriction at its output face, said concave configuration being such as to provide an internal cross-section (as defined) of the aperture which section has an area greater than the area of the aperture at the input face and also greater than its area at the output face (for the purposes of this specification an axial section of an aperture is one which contains the central axis of the aperture normal to the faces of the dynode and a cross-section is one which is parallel to the dynode faces).

Preferably said constriction is provided as a gradual taper so that the multiplier surfaces of an aperture are inclined to the axis of the aperture and converge towards each other in the direction of the output face of the dynode. In such an arrangement the overhang at the input end of an aperture makes it possible to concentrate more of the incoming electrons on the more productive area which lies in the inclined converging output region of the aperture, and the latter area is placed in the path of the electron flow by the inclined converging form of said region.

If the apertures are circular in cross-section, their concave inner surfaces may for example have a substantially spherical form or other solid form curved in all three dimensions, (e.g. a sphereidal form) or they may be made up of substantially conical sections as will be explained.

As viewed in axial section, the apertures may conveniently be symmetrical about a median cross-sectional plane. As for relative dimensions, good practical results have been obtained with input and output diameters or widths approximately equal to each other and to the thickness of the dynode.

Since the gain obtainable with a single-dynode is low, it is desirable (particularly for imaging applications) to employ a set of dynodes in cascade to form a channel plate structure of the laminated type. Thus according to a second aspect, the invention provides a channel plate structure of the laminated type comprising a plurality of dynodes as defined above in accordance with said first aspect of the invention which dynodes are separated from each other and arranged in cascade with aligned apertures providing the channels. The structure also includes preferably an input dynode which has its apertures aligned with those of the other dynodes and has an aperture form which is tapered and opens out in the direction of incoming electrons. In such structures the mutual separation of the dynodes can be effected in accordance with any of the separator arrangements referred to above provided the conductor layers are arranged to provide all, or substantially all, the secondary emission or dynode action. The alignment of the apertures is not necessarily normal to the faces of the plate as will be explained.

Embodiments of the invention will now be described by way of example as applied principally to aperture configurations which have circular cross-sections with input and output diameters equal or approximately equal to each other and to the dynode thickness and have separators of insulating (as opposed to resistive) material. Such embodiments will be described with reference to FIGS. 4 to 9 of the accompanying diagrammatic drawings, while FIGS. 10 to 12 of the accompanying drawings show a tilted dynode stack arrangement and illustrate two applications of the invention to imaging tubes.

Figure 4:
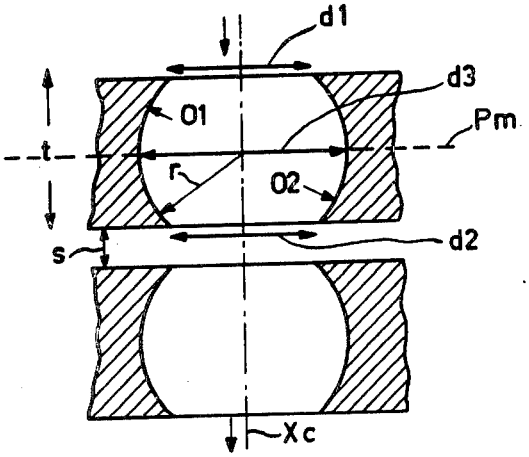

Dealing first with the individual aperture configuration, FIG. 4 shows in axial section a spherical form of aperture which is symmetrical about a median cross-sectional plante Pm. For test purposes, single-channel multipliers have been made of such shapes with the input and output diameters d1–d2 each substantially equal to the dynode thickness t; the centre of curvature was (because of the symmetry adopted) midway along the axis Xe of the aperture (in this case the axes of the individual apertures coincide with the axis of the whole channel). Large gain increases have been observed from 10-dynode multipliers when compared with comparable multipliers having forms such as those of FIGS. 1A or 1B. The highest gain to date is $10^6$ for a 10-stage single-channel test device and over $10^5$ for 10-stage arrays of channels.

The concave configuration shown is such that the internal cross-section of the aperture on the plane Pm has an area greater than the area of the aperture at the input face (diameter d1) and also greater than its area at the output face (diameter d2).

It appears that the radius of curvature r and the inter-dynode spacing s are not very critical and also the substantial variation of d1 and d2 is tolerable. In particular, it appears that the symmetry d1=d2 is not essential, in other words the origin of the radius r does not have to lie half-way along the axis of the aperture.

The concave shape of the aperture is not critical and can be varied in many ways, provided that a region of input overhang (01) and gradual constriction or inclined convergence in the output region (02) are retained.

For example, the radius of curvature in the axial planes may differ from the radius of the maximum cross-section (d3/2) and there may be two different radii of curvature for the input and output halves.

As a further variant, the spherical form may be approximated by a series of conical or substantially conical surfaces, and in an extreme case it is possible to use merely two opposed conical surfaces. However, conical surfaces are difficult to obtain and do not appear to offer any advantages over curved profiles.

Yet another variant consists in adopting nonspherical curved forms which can be readily obtained by etching. A preferred method is to chemically etch through exposed and developed patterns in photoresist in a manner well-known in the art, each dynode being made in two parts which may or may not be equal in thickness (a symmetrical example is given in FIG. 5 where the composite dynode is divided along the median plane PM). Exposure and etching of each half can be applied on the one side where the holes have largest area. Dynode materials may be metals having good secondary emissions properties (e.g. BeCu alloy) or cheap metals such as mild steel coated with secondary emitting surfaces (for example an oxidized BeCu film or and MgO coating).

Figure 6:
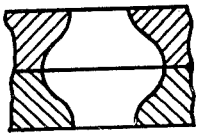

As a particular example of this process, the two halves of the dynode may be a pair of matched shadow-masks as made for colour T.V. display tubes, and an example is illustrated in FIG. 6 as an axial section of one channel. In this arrangement the output half of each apertures has appropriate surface treatment to ensure the requisite secondary-emissive properties and the form of each half is similar to the form shown in FIG. 3.

Figure 7:
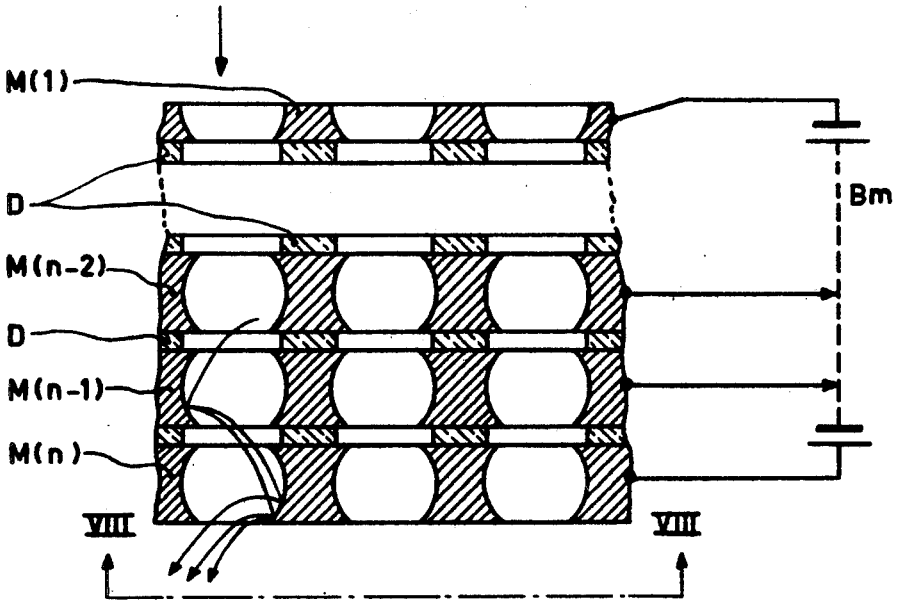
Figure 8:
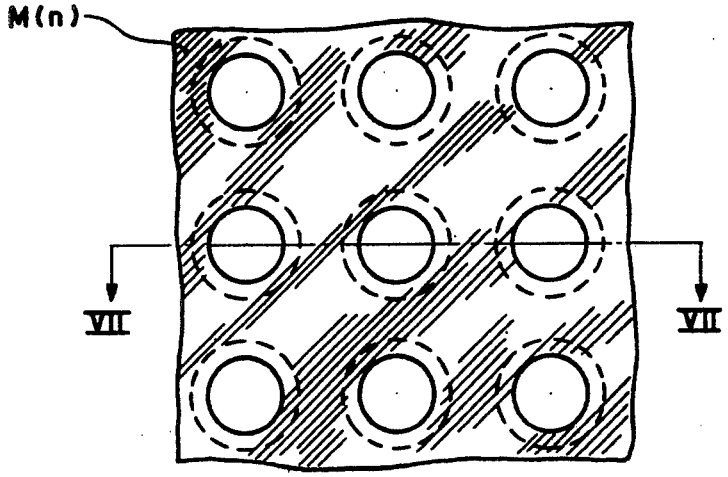

An assembly of dynodes forming a laminated channel plate is shown in FIGS. 7–8 with channels having axial sections of a form similar to that of FIG. 4 (if the dynodes are made from two symmetrical halves as described with reference to FIG. 5, then the first dynode M(1) can be constituted by one such half-plate).

FIG. 7 is an axial section while FIG. 8 is an elevation taken from the line VII—VII of FIG. 7. The last three stages of the channel plate are shown having metal dynodes M(n-2), M(n-1) and M(n) separated from each other by insulating separator layers D. Since plate M(n) is the last one of the series, it takes the place of the output electrode of a continuous-dynode channel plate. Similarly, there is a first plate M(1) which takes the place of the input electrode of a continuous-dynode channel plate.

In operation, all the M plates or dynodes are fed, as shown, with increasing potentials by a tapped D.C. supply source shown schematically at Bm.

The stack can be made from half-plates with tapered holes by depositing each separator layer on a half-plate on that side where the holes have smallest area, but it is undesirable for separator material to be deposited inside the tapered holes. One method of manufacture which avoids this is to apply the separator material in the form of a continuous sheet, and to use the perforated metal half-dynode as a mask through which holes may be etched in the separator. Coating of perforated mild steel half-plates (on one side) with a layer of glass can be done by enamelling or by electrophoresis of by means of a process similar to the Vitta Tape process (Vitta Tape is a product of the Vitta Corporation of America). A glass-loaded adhesive tape is applied over that surface of each half-plate where the holes have smallest area. Each coated half-plate is then heated until the glass coating type takes on a vitreous form. The glass side is then coated with an etch-resist and holes are etched into the glass through the plate apertures, hydrofluoric acid being a possible etchant. After etching, the resist is removed and pairs of half-plates are joined together in registration and heated until the remaining glass melts and bonds them together. Such pairs of half-plates are then assembled into a stack and the joints between the pairs of mating half-dynodes can be effected e.g. by gold diffusion bonding.

If the material adopted for the conductor layers (e.g. mild steel) is not sufficiently secondary-emissive for a particular application, the secondary-emissive dynode properties of some or all of the conductors can be enhanced by providing a coating of a more emissive material on the exposed surfaces of the conductors inside the channels.

The glass separator layers D can be etched back by a separate stop subsequent to assembly and bonding of the stack of plates. As a result the apertures in D are greater than the largest cross-section of the metal plate apertures.

Figure 5:
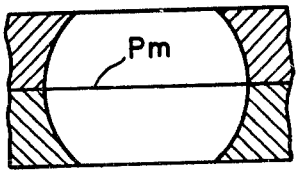

Although symmetrical examples have been illustrated in FIGS. 4 to 8 of the drawings, it has been explained above that it is not necessary for a dynode according to the invention to be symmetrical about the median plane (e.g. the plane Pm of FIGS. 4 and 5). Accordingly, other structures which are not symmetrical in this sense will now be described by way of example with reference to FIG. 9.

Figure 9:
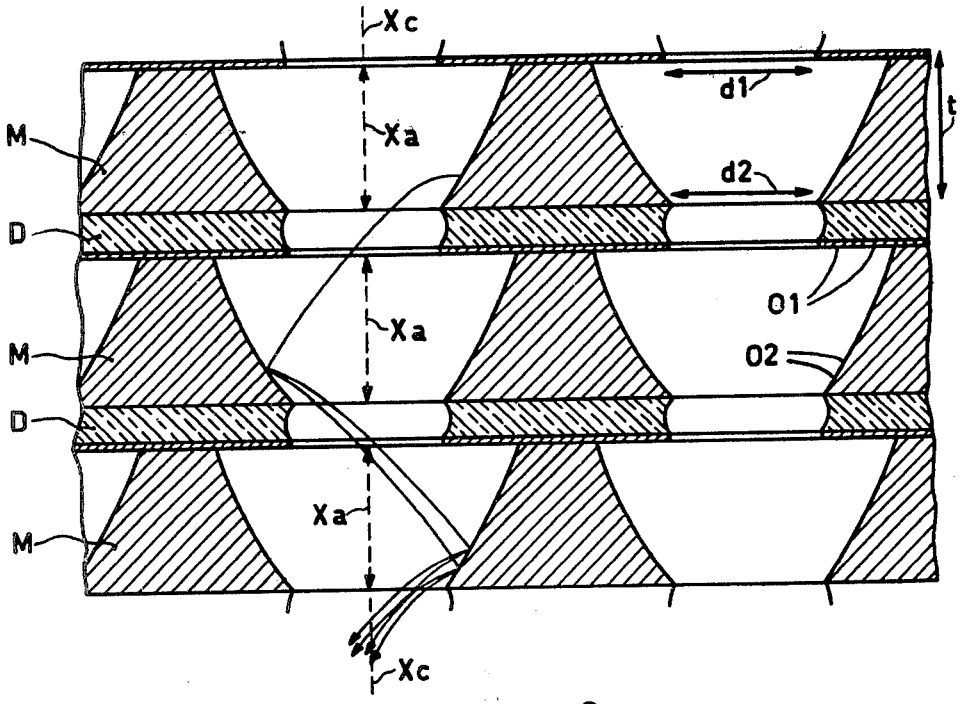
Figure 10:
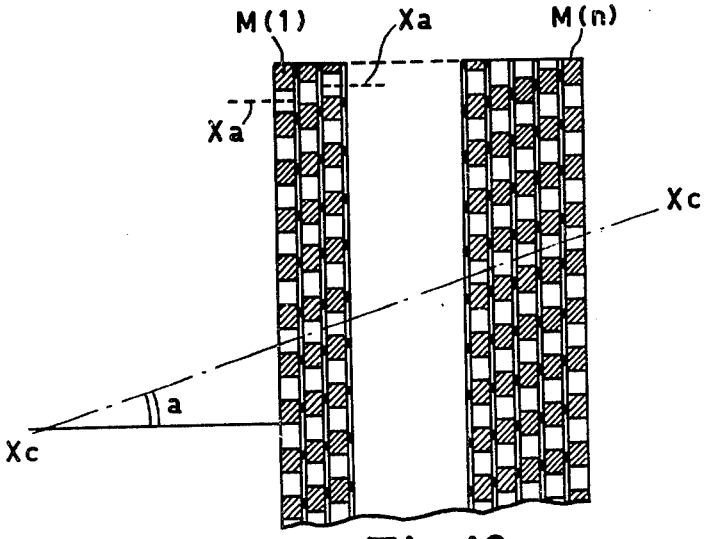

In FIG. 9 each metal dynode M has apertures of approximately conical form with apertures axes Xa which coincide with the general channel axis Xe. The output region 02 provides the operative multiplying surfaces which are inclined to the axis of the aperture and converge towards each other in the direction of the output face of the dynode. The approximately conical part of each aperture cooperates with a conductive overhanging surface 01 which may be provided as a layer on the adjacent separator D. The layer 01 may be applied to the entire separator, as shown, and this may facilitate manufacture by allowing each separator to be coated completely before the dynodes (M) and separators (D) are assembled as a stack. However, this is not essential from the operational point of view since it is sufficient for each overhanging layer 01 to be in electrical contact with the adjacent M-plate so as to provide therewith the desired concave configuration when viewed in an axial plane. The separators D may be etched back from the edges of the apertures e.g. as shown.

As a variant to the FIG. 9 arrangement a straight-sided axial section may be adopted so as to produce a truly conical aperture form to replace the curved profile shown, and the profile in axial section is still concave in that there is a peripheral cavity between the conical wall and the flat overhang 01. However there do not appear to be any clear advantages in doing this and additional manufacturing problems would arise.

In the example of FIG. 9 the dimensional proportions of the apertures are the same as those of FIG. 4 in the sense that the input and output diameters (d1-d2) are substantially equal to each other and to the dynode thickness t.

Whereas the dynode apertures of the examples illustrated in the drawings have rotational symmetry about their individual axes, it is possible (subject to the requirements of the manufacturing processes) to employ apertures which have non-circular cross-sections, for example square or hexagonal cross-sections. Thus, for example, the arrangements of FIGS. 4–5 can employ apertures of square cross-section having four cylindrical walls (the axial section shown remains unaltered) and similarly the arrangement of FIG. 9 can employ approximately pyramidal apertures of square cross-section. If apertures of square cross-section are thus used, the input and output widths may be approximately equal to each other and to the dynode thickness.

Although described as having continuous separator layers D of insulating material, the assemblies of FIGS. 7–8 and 9 may have layers D of resistive material and/or said layers may be discontinuous e.g. in the form of arrays of lines or dots in accordance with the aforesaid patent specification Nos. . . . (application 53371/71; PHB 32212) and No. . . . (application 59966/71; PHB 32220).

As aforementioned, the alignment of the apertures does not have to be orthogonal to the faces of the plate. Thus the laminated construction of the matrix permits successive conductor layers to be displaced with respect to each other so as to enable their apertures to form channels which depart from the conventional configuration of straight channels normal to the channel plate faces. This may be done to achieve various effects which have been described earlier in relation to continuous-dynode plates. Thus, for example, the dynodes may be continuously staggered conductor layers arranged to provide channels which are at an acute angle to the normal to the faces of the channel plate (this arrangement can e.g. prevent orthogonal electrons from passing through without collisions and it can also prevent optical and ion feedback from a display screen to a photo-cathode on the input side of the plate). An example of such a construction is shown schematically in FIG. 10 where a stack of dynodes is staggered to tilt the channel axes Xe at an acute angle $\alpha$ to the normal to the faces. (In this case the tilted axis Xc of a complete channel must be distinguished from the axes Xa of individual apertures which axes are still normal to the faces of the channel plate). In a similar manner variably staggered conductor layers may be arranged to provide curved channels to prevent ion and optical feedback.

Such staggering of the dynodes may reduce their multiplying efficiency, but the gains obtainable are so high that some loss can often be tolerated in the interests of preventing feedback.

Channel plates according to the present invention can incorporate various features which have been described for continuous dynode channel plates. Thus in image intensifier applications it is sometimes desirable to provide a thin layer or membrane across an end (usually the entrance) of each channel, and the following are specific examples:

(A) The provision of a photo-emissive layer across each channel entrance as described in patent specification No. 1,154,515 (PHB 31754).

(B) The provision of electron-permeable conductive membranes across the channel entrances as described in patent specification No. 1,175,599 (PHB 31816).

Channel plates according to the present invention can be used in a variety of imaging tubes, typical examples being image intensifiers and cathode ray tubes. As aforesaid, the invention has particular advantages in applications requiring large-area viewing screens, for example television display applications and X-ray image intensifiers. (In particular, channel plates according to the invention may replace those used in the colour display applications described in patent specification No. . . . (Co-pending application No. 42723/71; PHB 32193)).

Figure 11:
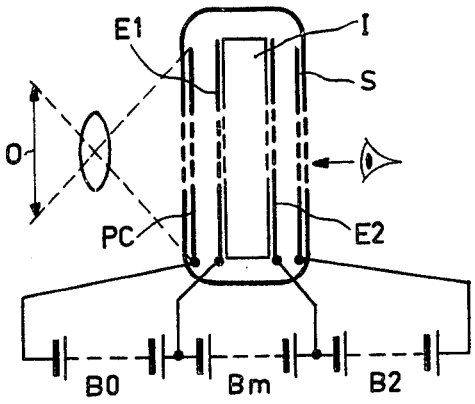

FIG. 11 of the accompanying drawings illustrates schematically the use of channel plates in accordance with the invention in an image intensifier tube of the proximity type. In the example given a channel plate I (which may be as described with reference to any of FIGS. 4 to 10) is shown inside the envelope of an image intensifier tube containing also a photo-cathode PC and a luminescent screen S. The input and output electrodes of the channel plate are shown at E1 and E2 respectively and an object 0 is shown imaged on to the photocathode. Electrodes E1–E2 correspond to the first and last dynodes of the stack (e.g. M(1) and M(n) of FIG. 7). The source Bm has toppings (not shown) so as to supply individual dynodes e.g. as shown in FIG. 4 while sources Bo and B2 provide the required potentials for the PC-E1 and E2-S stages.

Figure 12:
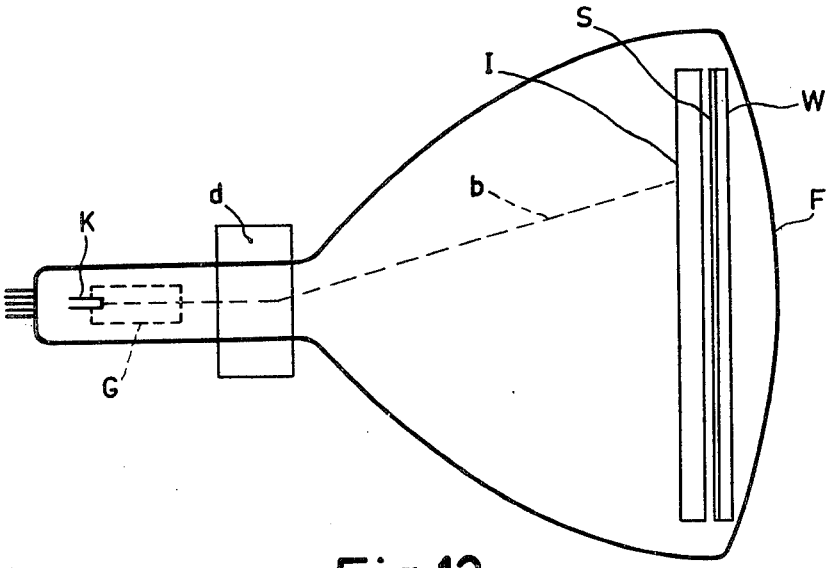

A second example of an imaging tube is given in FIG. 12 which shows a cathode-ray display tube comprising an electron gun G (including a cathode K) for generating a beam b which is deflected by means d so as to scan a channel plate I constructed in accordance with the invention. The plate I is followed by a luminescent screen S which may be laid on a flat glass window or support W as shown. Alternatively, the screen S may be laid on a curved face-plate F forming part of the envelope, in which case the channel plate I may be correspondingly curved.

In the case of BeCu the dynodes can be made from two dynodes halves bonded together using a copper-silver cutectic braze; One half (preferably the input half) is silver plated and both are then clamped together and heated.

What is claimed is:

1. In a channel plate electron multiplier of the laminated discrete dynode type wherein conductive sheets are stacked in closely spaced relation, said sheets having apertures with inner surfaces which are conductive and secondary-emissive, said apertures being aligned to form electron multiplying channels, an improved profile for said apertures comprising an input cross-section and an output cross-section which are approximately the same and a concavely shaped inner surface profile so that the majority of electrons tend to strike said inner surface close to the output end of said apertures and the gain of the multiplier is increased.

2. An improved profile for discrete dynode apertures in a channel plate electron multiplier as defined in claim 1 wherein said apertures are characterized by a gradually decreasing cross-section at the output end thereof.

3. An improved profile for discrete dynode apertures in a channel plate electron multiplier as defined in claim 2 wherein said apertures are characterized by a suddenly increasing cross-section at the input end thereof.

4. An improved profile for discrete dynode apertures in a channel plate electron multiplier as defined in claim 2 wherein said apertures are characterized by a gradually increasing cross-section at the input end thereof.

5. An improved profile for discrete dynode apertures in a channel plate electron multiplier as defined in claim 4 wherein said inner surfaces have approximately spherical form.

6. An improved profile for discrete dynode apertures in a channel plate electron multiplier as defined in claim 1 wherein the axial dimension of said apertures is approximately equal to the diameter of said apertures at the input end thereof.

* * * * *